US006045017A

United States Patent [19]

Connell

[11] Patent Number: 6,045,017

[45] Date of Patent: Apr. 4, 2000

[54] COLLAPSIBLE HOLDER FOR CONTAINER

[76] Inventor: Kevin Connell, 1 Schneider La., Montville, N.J. 07045

[21] Appl. No.: 09/102,650

[22] Filed: Jun. 22, 1998

[51] Int. Cl.[7] ..... A45F 3/16; A45F 5/00

[52] U.S. Cl. ..... 224/148.7; 224/184.4; 224/197; 224/679; 224/673; 224/675; 224/666; 248/311.2

[58] Field of Search ..... 224/148.1, 148.46, 224/148.7, 926, 197, 198, 199, 232, 660, 665, 666, 673, 675, 676–679; 248/311.2

[56] References Cited

U.S. PATENT DOCUMENTS

| | | | |
|---|---|---|---|
| 2,649,270 | 8/1953 | Franks | 248/311.2 |
| 3,391,891 | 7/1968 | Garden | 24/311.2 |
| 4,805,819 | 2/1989 | Collins | 224/232 |
| 4,830,247 | 5/1989 | Banks | 224/197 X |
| 5,031,821 | 7/1991 | Finn et al. | 224/197 X |
| 5,056,696 | 10/1991 | Lahr | 224/148.4 |
| 5,285,940 | 2/1994 | Goulter | 224/148.4 |
| 5,390,838 | 2/1995 | Jafarkhani | 224/148.4 |
| 5,490,618 | 2/1996 | Davidson | 224/148.4 |

FOREIGN PATENT DOCUMENTS

| | | | |
|---|---|---|---|
| 357164821 | 10/1982 | Japan | 224/926 |

*Primary Examiner*—Gregory M. Vidovich
*Attorney, Agent, or Firm*—Thomas L. Adams, Esq.

[57] ABSTRACT

In accordance with the illustrative embodiments demonstrating features and advantages of the present invention, there is provided a holder for allowing a person to carry a beverage container, hands free. The holder has a collapsible frame for holding the container. The frame includes (a) a backer, and (b) a subjacent support attached to the backer to reciprocate thereon. The holder also has a compliant device attached to the backer for swingably appending the backer to the person or apparel of the person. Thus the collapsible frame can adjust with movement of the person.

17 Claims, 3 Drawing Sheets

COLLAPSIBLE HOLDER FOR CONTAINER

BACKGROUND OF THE INVENTION

1. Field of the Invention

The present invention relates to holders for beverage containers, and in particular, to holders that can be carried by a person, hands free.

2. Description of Related Art

Many activities require a person to stay mobile and to keep his or her hands free. At the same time, the person may wish to keep a beverage container convenient. For example, fishing often requires the use of two hands to deal with a fishing rod. Furthermore, the angler may need to move about and in some cases may need to bend over a tackle box to fetch lures, bait, etc. One might attempt to attach a beverage container to the belt of a person for these times. However, an active person will probably bend over and inadvertently spill the contents of the container.

U.S. Pat. No. 1,109,161 shows an assembly for holding a number of paint cans. A trio of cages is shown pivotally attached to a tray that is in turn attached to a belt worn about the waist of a painter. Each of the cages are designed to hold a paint can. The cages are mounted to swing on arms as the painter bends over. This assembly is relatively complicated and cannot be conveniently stored and transported. For example, an angler would have great difficulty fitting this assembly into a tackle box. U.S. Pat. No. 5,340,006 shows another holder that is supported on arms that attach to head gear. This is also a large and complicated assembly that cannot be conveniently transported. See also U.S. Design Pat. No. 296,268.

U.S. Pat. No. 5,016,791 shows a paint can supported by its handle on a clip attached to a girdle. The paint can is encircled by a band that is pivotally attached to a panel that is supported by the girdle. A disadvantage with this arrangement is the fact that the can does not have subjacent support. Therefore, the weight of the can is supported by the clip in the girdle. This weight on the clip prevents the handle from slipping as intended, and therefore impedes the paint can from easily turning as the painter moves about.

U.S. Pat. No. 5,490,618 shows a cradle for holding a paint can on an elongated member that is pivotally attached to a waist belt. This assembly is not collapsible and is therefore not conveniently transported.

U.S. Pat. No. 4,867,358 shows a container mounted inside another container that is pivotally attached to a strap assembly. Accordingly, this assembly remains as large as the container and is therefore neither collapsible nor easily transported.

U.S. Pat. No. 3,380,635 shows a panel with a flap designed to fit into a pocket. A band attached to the panel can encircle a container without supporting its underside. U.S. Pat. No. 4,993,611 shows a beverage container support designed to be worn around the neck. Again, this reference does not support the underside of the container. Thus for both of these designs, there will be a tendency for the container to slip downwardly.

See also U.S. Pat Nos. 4,629,153; 5,056,696; and 5,232,137.

Accordingly, there is a need for a device that allows a user to carry a beverage container, hands free, and that is also collapsible and therefore easily transported.

SUMMARY OF THE INVENTION

In accordance with the illustrative embodiments demonstrating features and advantages of the present invention, there is provided a holder for allowing a person to carry a beverage container, hands free. The holder has a collapsible frame for holding the container. The frame includes (a) a backer, and (b) a subjacent support attached to the backer to reciprocate thereon. The holder also has a compliant means attached to the backer for swingably appending the backer to the person or apparel of the person. Thus the collapsible frame can adjust with movement of the person.

By employing apparatus of the foregoing type, an improved container holder is achieved. In a preferred embodiment, a subjacent floor panel is hinged to a backer panel. Preferably, a hook-like device is pivotally connected to the backer panel and can be used to hook the assembly onto the belt of a user. In other embodiments the hook can be replaced with a strap or other device that can attach the backer panel to the person or the person's apparel.

It is also preferred to hinge a pair a parallel hoops (or other embracing devices) to the backer panel. These hoops can fold up against the backer panel together with the subjacent floor panel. It is also preferred to use a pair of side bars that are pivotally connected to the hoops and the subjacent floor panel. In that embodiment, the bars allow the hoops and the floor panel to fold up together against the backer panel.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein.

DETAILED DESCRIPTION OF THE PREFERRED EMBODIMENTS

Figure 1:
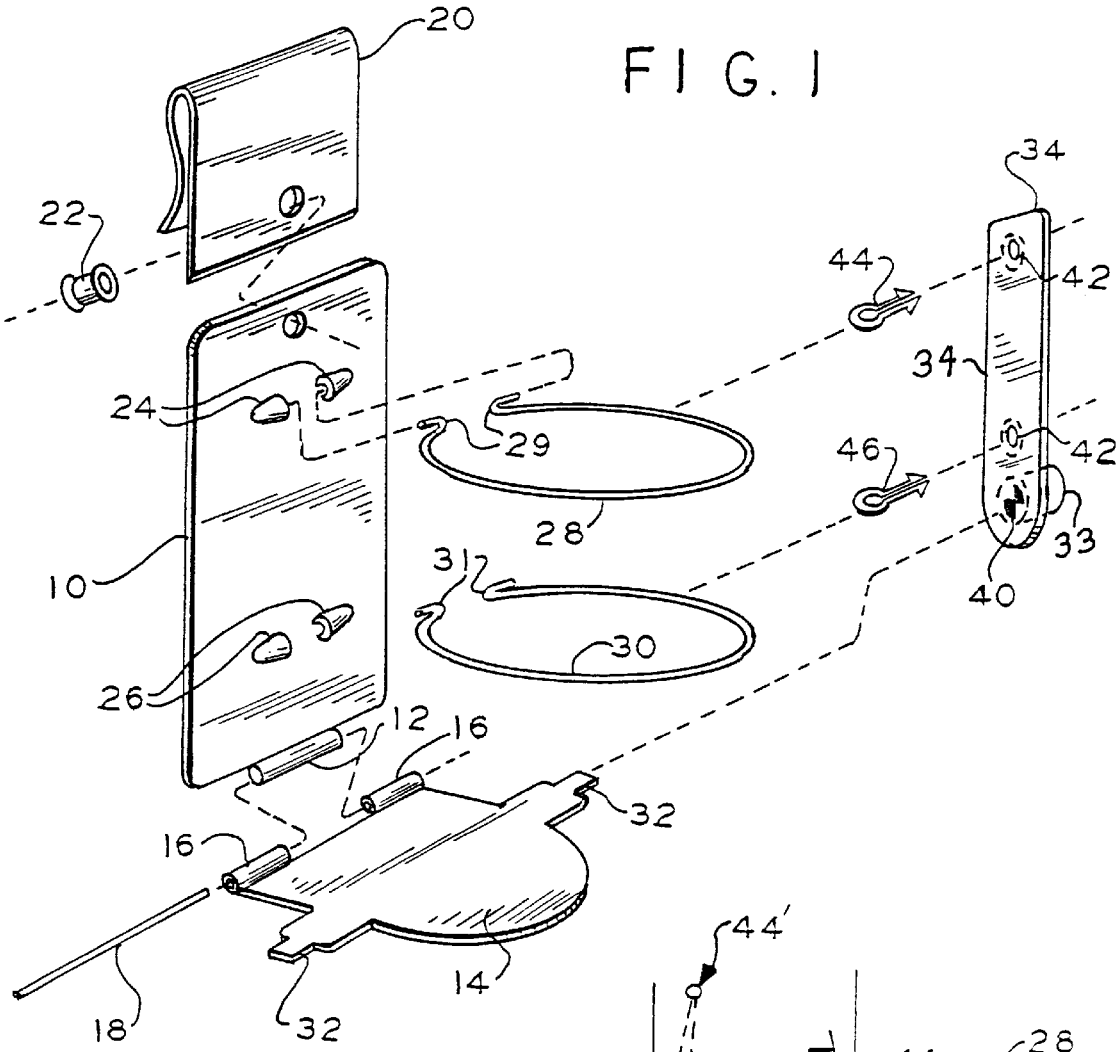
FIG. 1 is an exploded view of a portion of a holder in accordance with teachings of the present invention.
Figure 2:
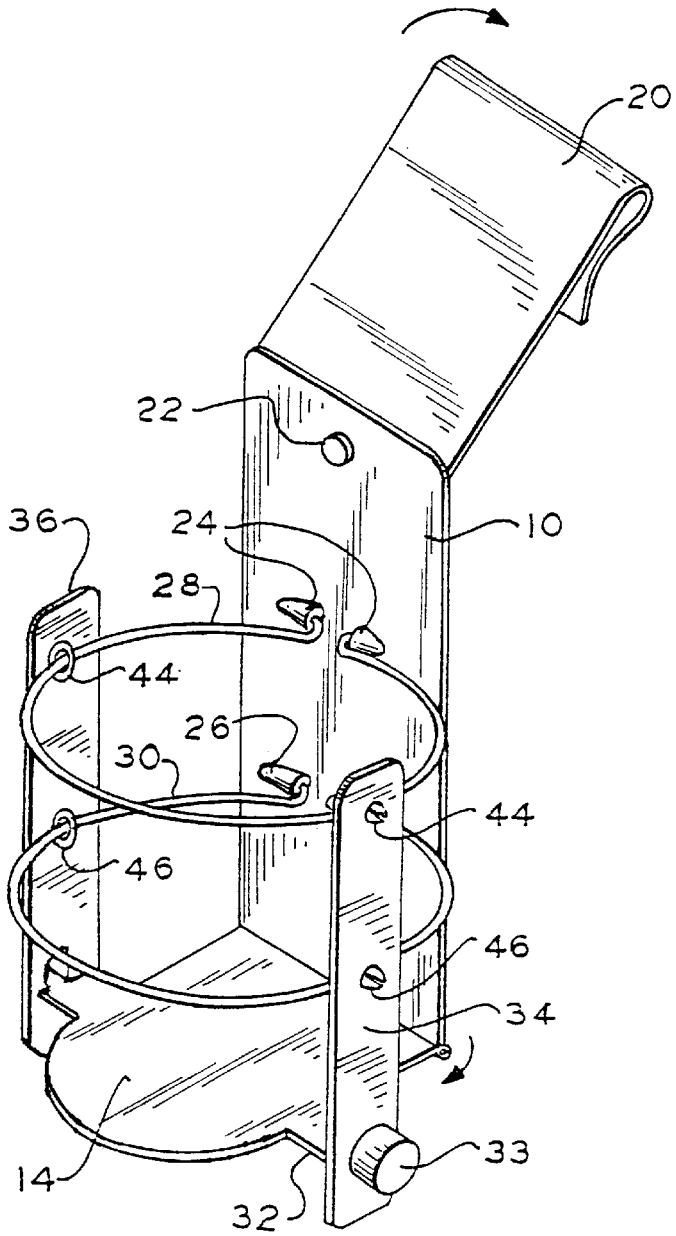
FIG. 2 is an axonometric, assembly drawing of the holder of FIG. 1.

Referring to FIGS. 1 and 2, the illustrated holder is shown as a collapsible frame having a backer in the form of an upright panel 10. Panel 10 is preferably a molded plastic panel having openings to pivotally support the components that will be described presently. In some embodiments, panel 10 can be made from stamped metal or other materials.

Panel 10 has a tubular member 12 for pivotally supporting a subjacent support 14. Support 14 has a pair of tubular members 16 that coaxially straddle tubular member 12. A hinge pin 18 is inserted through tubular members 12 and 16 to hinge the backer 10 and the support 14 together. Support 14 acts as a floor and may be a molded plastic unit, although other embodiments will employ stamped metal or other materials.

A compliant means 20 is shown pivotally attached to the upper end of panel 10. Means 20 is shown herein as a clip or hook that is riveted to panel 10, although other means of attachment are contemplated. Rivet 22 is loosely connected to both elements 10 and 20 to allow the clip 20 to swing freely. Clip 20 is preferably a strip of spring steel that has been bent into the illustrated shape, although other materials and shapes can be employed in alternate embodiments. Clip 20 is designed to clip onto a waist band or belt of a user.

Backer panel 10 is shown with two pairs of scoop-like bosses 24 and 26. These bosses 24 and 26 are designed to support a pair of hoops 28 and 30, which are also referred to as a lateral means. Hoops 28 and 30 are open, or C-shaped elements. The ends of the hoops 28 and 30 are bent into J-shaped elements 29 and 31, respectively, designed to snap into the bosses 24 and 26.

Flat strip projections 32 protrude from each side of the support 14. Each end of strip projections 32 act as a journal. A pair of sidebars 34 and 36 are shown in the shape of identical strips having a lower boss 33. Boss 33 contains a cavity that forms a socket 40 with a bow tie-shaped opening. Socket 40 is shaped to receive the flat strip projections 32. Socket 40 allows flat strip projections 32 and thus support 14 to rotate approximately 90 degrees.

Sidebars 34 and 36 each have a pair of holes 42. A pair of devises 44 and 46 are each shown as a device having a loop at one end, which is opposite a pair of barbed ends that snap into the holes 42. The devises 44 and 46 are used by placing their looped ends around the hoops 28 and 30. Then the devises 44 and 46 are snapped into the holes 42. Consequently, the hoops 28 and 30 are supported on the sidebars 34 and 36 to rotate about axes passing through the devises 44 and 46. These axes are parallel to the center line of strip 32, which acts as an axle journaled in the sockets 40. Alternate embodiments may grip a hoop with a simple C-shaped clip, which will have projecting therefrom a split shank with similar barbs. This alternate type of clevis is arranged to accept the hoops by snapping them into the clip prepared for them, rather than encircling the hoops.

In the illustrated embodiment, sidebars 34 and 36 act as links to cause hoops 28 and 30 to fold upwardly together with support 14. During such folding, support 14 and hoops 28 and 30 remain substantially parallel.

Figure 4:
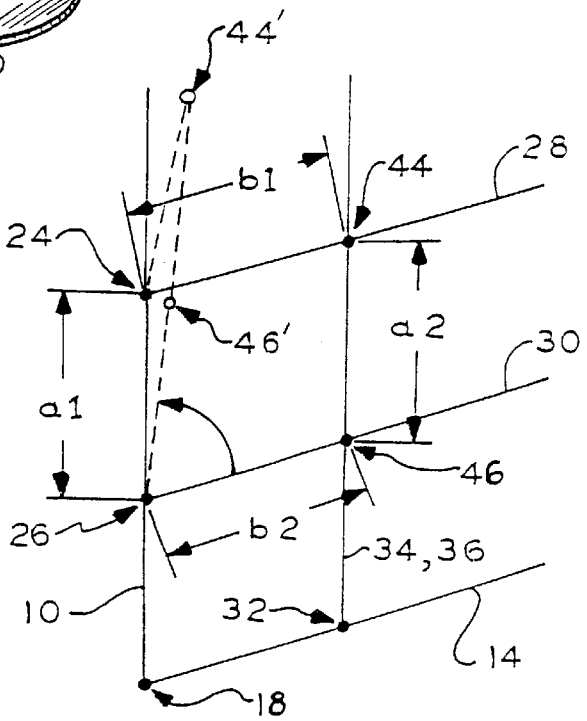
FIG. 4 is a schematic illustration of the pivoting relationship among the elements of the holder of FIG. 2.
Figure 3:
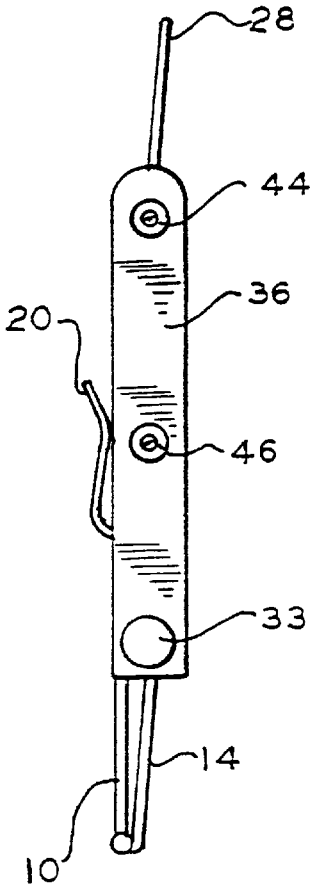
FIG. 3 is a side view of the holder of FIG. 1 after folding.

Referring to FIGS. 3 and 4, support 14 and hoops 28 and 30 are shown folding toward, or folded against, backer 10. In the schematic side view of FIG. 4, the axes formed at locations 18, 24, 26, 32, 44, and 46 approximately form a stacked pair of parallelograms. Alternatively, a single large parallelogram may be deemed formed with vertices at locations 18, 24, 32 and 44. In this arrangement, the axes are not laid precisely symmetrically to form a parallelogram. Instead, a first distance between locations 24 and 18 is greater than a second distance between locations 44 and 32. A third distance between locations 24 and 44 is equal to a fourth distance between the locations 18 and 32 (this same distance exists between locations 26 and 46).

These distances can be adjusted in various ways, but it is desirable if the first and third distances have a sum that is different than that of the second and fourth distances. This inequality is achieved in this embodiment by making distance a1 greater than distance a2, while distances b1 and b2 are equal. This relationship eventually causes the elements to reach the positions shown in phantom in FIG. 4. It will be noted that the locations 44 and 46 move to the new positions illustrated as locations 44' and 46'. Locations 44' and 46' are then aligned with location 26. When this alignment is achieved, location 24 then becomes the vertex of a triangle, which means that the arrangement cannot fold any further without slight deformation of components. If the user continues to fold the elements further, then such deformation occurs and the triangle shown in phantom in FIG. 4 will invert, thereby causing the assembly to snap into a folded position.

Figure 5:
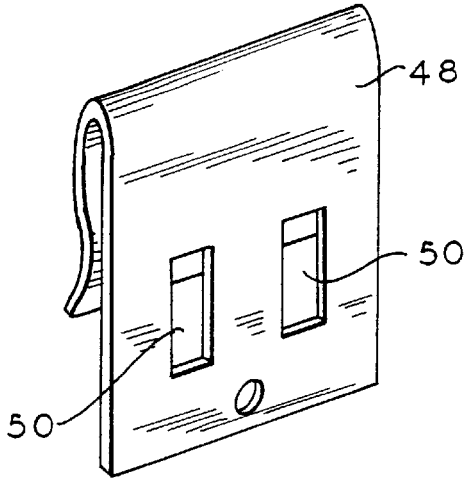
FIG. 5 is a detailed, axonometric view of a compliant means that is an alternate to that of FIG. 2.

FIG. 5 shows a fixture 48 that is similar to clip 20 of FIG. 2, but modified to include a pair of slots 50. A user can thread his or her belt through these slots 50 to attach the holder to the person's waist. Alternatively, a loop can be attached to the face of the fixture 48 to allow a belt to be threaded through the loop for the same purpose. While fixture 48 is shown formed as a hook, in other embodiments the fixture can be a simple flat element with the illustrated belt slots.

Figure 6:
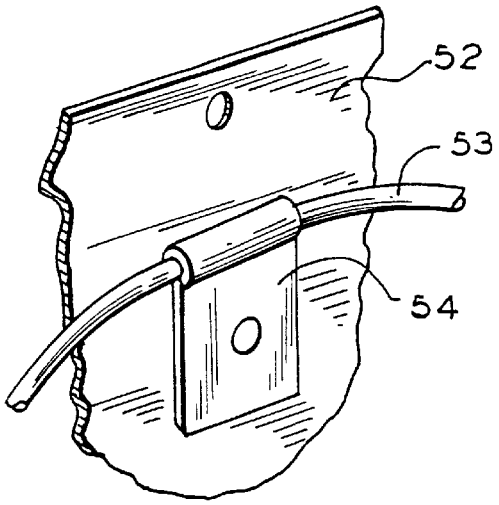
FIG. 6 is a detailed, axonometric view of a lateral means, which is an alternate to that of FIG. 2.

Referring to FIG. 6, the previously mentioned backer (backer 10 of FIG. 2) has been replaced with an alternate backer 52. Backer 52 has a similar outline, but a different structure for supporting a lateral means. In this embodiment the previously mentioned hoop is a closed annulus 53 that is pivotally attached to the backer 52 by means of a clamp 54 that is riveted to the backer 52. Therefore, hoop 53 can rotate relative to backer 52 in a fashion similar to that previously described in connection with FIG. 2.

Figure 7:
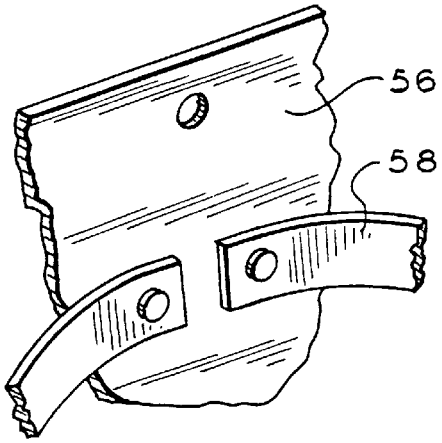
FIG. 7 is a detailed, axonometric view of a lateral means, which is an alternate to that of FIG. 6.

Referring to FIG. 7, an alternate backer plate 56 is shown with an alternate lateral means in the form of a flexible strap 58. Strap 58 has a pair of ends that are riveted to the backer plate 56. Preferably, strap 58 is an elastic band that can grip a container that is placed within the compass of strap 58.

Figure 8:
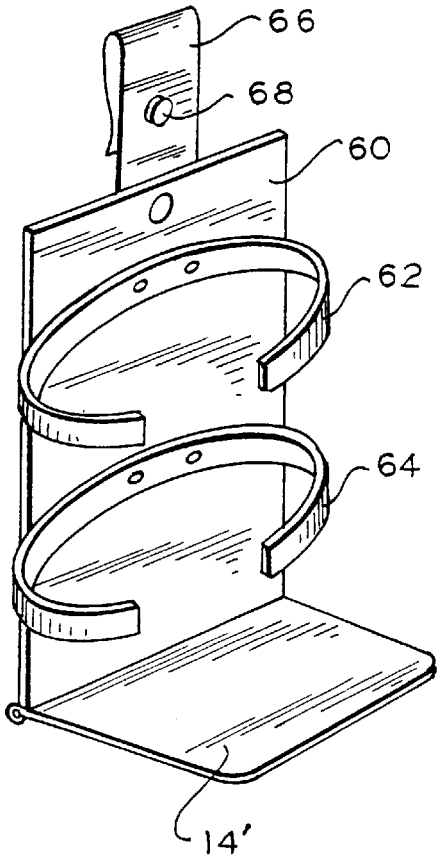
FIG. 8 is an axonometric view of a compliant means that is an another alternate to that of FIGS. 2 and 5.

Referring to FIG. 8, an alternate support 14' is shown hinged to an alternate backer 60. The pair of C-shaped lateral means 62 and 64 are shown riveted to the face of backer 60. Each of the means 62 and 64 is a pliable band having a pair of arms that are designed to embrace a container that is placed within the compass of the lateral means 62 and 64.

An alternate compliant means is shown herein as a flexible strap 66 that is attached to the backer 60. The joint between the strap 66 and backer 60 is sufficiently flexible to provide two degrees of freedom to the strap 66. The strap 66 is folded back on itself and closed to form a loop by means of snap 68. Thus, the loop formed by strap 66 can be opened, placed around a waist belt, and then closed by means of snap 68.

To facilitate an understanding of the principles associated with the foregoing apparatus, its operation will be briefly described in connection with the embodiment of FIG. 2. A user may secure the holder of FIG. 2 to a waist belt by hooking the clip 20 to such a belt (not shown). Thereafter, a beverage container such as a soda can or beer can (not shown) will be placed through the hoops 28 and 30 to rest upon the upper surface of support 14.

The hands of the user will then be free to engage in other activities. For example, an angler can use both hands to operate a fishing pole. Also at this time, the user may wish to bend over to reach a tackle box or to perform other activities. The backer 10 can swing at this time relative to the clip 20. The backer 10 will be suspended in a pendulum-like manner to keep the backer 10 substantially vertical. This will keep the beverage container within the holder from tipping and spilling.

When the user is done with the holder, the container can be removed from the compass of hoops 28 and 30 and discarded. Then the clip 20 can be removed from the waist belt and swung down to the position shown in FIG. 3. Next, support 14 can be folded upwardly toward the backer 10. This simultaneously drives sidebars 34 and 36 upwardly, to keep hoops 28 and 30 in a substantially parallel relation to the support 14. Eventually, the hoop 30 will be aligned with sidebars 34 and 36, as shown in phantom in FIG. 4. If the support 14 is folded further, the previously mentioned triangular configuration of FIG. 4 will invert and lock the assembly in the folded position shown in FIG. 3. In this very compact configuration, the assembly can be easily stored in a tackle box or other storage device.

When the device is to be used again, support 14 can be folded down to the position shown in FIG. 2. Also, the clip 20 can be deployed as before to allow reuse of the holder.

It is appreciated that various modifications may be implemented with respect to the above described, preferred embodiment. While various flat surfaces are shown for engaging the beverage container, in other embodiments these surfaces can be curved or shaped differently, depending upon the type of container, the desired support, etc. Instead of a side bar, other embodiments may use different linkages, including flexible lines, or linkages that are located closer to the backer plate. Instead of a circular hoop, the lateral means may have a polygonal or other shape. In still other embodiments, the lateral means may be a spring, an elastic cord, or other flexible elements. The various illustrated shapes, dimensions and other features can be altered, depending upon the desired strength, capacity, flexibility etc.

Obviously, many modifications and variations of the present invention are possible in light of the above teachings. It is therefore to be understood that within the scope of the appended claims, the invention may be practiced otherwise than as specifically described.

I claim:

1. A holder for allowing a person to carry a beverage container hands free, comprising:

a collapsible frame for holding said container and having (a) a backer extending over a plane, and (b) a subjacent support attached to said backer to reciprocate thereon;

a lateral means for embracing the beverage container above said subjacent support, said lateral means being pivotally attached to said backer to fold against said backer;

at least one side bar pivotally attached between said lateral means and said subjacent support, said lateral means and said subjacent support are pivotally attached to (a) said backer about axes that are separated by a first distance, and (b) said side bar about axes that are separated by a second distance, said backer and said side bar being pivotally attached to (a) said lateral means about axes that are separated by a third distance, and (b) said subjacent support about axes that are separated by a fourth distance, said first and said third distances having a sum that is different than that of said second and said fourth distances; and a compliant means attached to said backer for swingably appending said backer to the person or apparel of the person to allow swinging in the plane of the backer, so that said collapsible frame is adjustable with movement of the person.

2. A holder according to claim 1 wherein said subjacent support comprises:

a floor hinged to said backer.

3. A holder according to claim 2 wherein said backer comprises an upright panel.

4. A holder according to claim 1 wherein said compliant means comprises:

a clip pivotally attached to said backer.

5. A holder according to claim 1 wherein said compliant means has a joint for allowing said collapsible frame to swing with two degrees of freedom.

6. A holder according to claim 1 wherein said compliant means comprises:

a flexible strap.

7. A holder according to claim 1 wherein said compliant means comprises:

a hook.

8. A holder according to claim 1 wherein said compliant means comprises:

a fixture with slots for receiving a waist belt.

9. A holder according to claim 1 wherein said subjacent support has a flat projection, said side bar having a socket with a bow tie-shaped opening sized to receive said flat projection and to permit it to rotate.

10. A holder according to claim 1 wherein said lateral means comprises a hoop.

11. A holder according to claim 1 wherein said lateral means comprises a pair of hoops.

12. A holder for allowing a person to carry a beverage container hands free, comprising:

a collapsible frame for holding said container and having (a) a backer extending over a plane, and (b) a subjacent support attached to said backer to reciprocate thereon;

a lateral means for embracing the beverage container above said subjacent support, said lateral means being pivotally attached to said backer to fold against said backer;

at least one side bar pivotally attached between said lateral means and said subjacent support, said subjacent support having a flat projection, said side bar having a socket with a bow tie-shaped opening sized to receive said flat projection and to permit it to rotate; and a compliant means attached to said backer for swingably appending said backer to the person or apparel of the person to allow swinging in the plane of the backer, so that said collapsible frame is adjustable with movement of the person.

13. A holder according to claim 12 wherein said compliant means comprises:

a clip pivotally attached to said backer.

14. A holder according to claim 12 wherein said compliant means comprises:

a hook.

15. A holder according to claim 12 wherein said compliant means comprises:

a fixture with slots for receiving a waist belt.

16. A holder according to claim 12 wherein said lateral means comprises a hoop.

17. A holder according to claim 12 wherein said lateral means comprises a pair of hoops.

* * * * *